United States Patent [19]

Ludwig

[11] Patent Number: 4,679,373

[45] Date of Patent: Jul. 14, 1987

[54] METHOD AND DEVICE FOR THE ALIGNING OF AN ELEMENT, E.G. FRAME, TO BE INSERTED INTO A WALL OPENING

[76] Inventor: Bernd Ludwig, Heylstrasse 33, D-6460 Gelnhausen, Fed. Rep. of Germany

[21] Appl. No.: 767,199

[22] PCT Filed: Dec. 10, 1984

[86] PCT No.: PCT/EP84/00395

§ 371 Date: Aug. 5, 1985

§ 102(e) Date: Aug. 5, 1985

[87] PCT Pub. No.: WO85/02648

PCT Pub. Date: Jun. 20, 1985

[30] Foreign Application Priority Data

Dec. 8, 1983 [DE] Fed. Rep. of Germany ... 8335189[U]
Mar. 7, 1984 [DE] Fed. Rep. of Germany ... 8406973[U]

[51] Int. Cl.[4] ..... E06B 1/58; E04F 21/00

[52] U.S. Cl. ..... 52/745; 52/2; 52/743; 52/217

[58] Field of Search ..... 52/2, 217, 204, 215, 52/127.1, 127.2, 127.3, 127.4, 127.6, 127.8, 745, 743

[56] References Cited

U.S. PATENT DOCUMENTS

| | | | |
|---|---|---|---|
| 2,960,734 | 11/1960 | Collins | 52/217 |
| 3,571,996 | 3/1971 | Braswell | 52/217 |
| 3,854,253 | 12/1974 | Slowbe | 52/2 |

FOREIGN PATENT DOCUMENTS

| | | | |
|---|---|---|---|
| 1509913 | 6/1969 | Fed. Rep. of Germany . | |
| 2260856 | 6/1974 | Fed. Rep. of Germany . | |
| 2520632 | 11/1976 | Fed. Rep. of Germany . | |
| 2617169 | 11/1977 | Fed. Rep. of Germany | 52/743 |
| 3022936 | 12/1981 | Fed. Rep. of Germany . | |

*Primary Examiner*—J. Karl Bell
*Attorney, Agent, or Firm*—Bierman & Muserlian

[57] ABSTRACT

A method and device is being proposed for the simple setting and positioning of a door frame (12) for example in a wall opening (10). Thereby inflatable air bags (20,22) are set between the corner areas of the frame (12) and the wall opening (10) which cause a vertical and horizontal power on the frame jambs (14, 16, 18), which are positioned with this power. Expanding elements (28, 30) can also be placed between the frame longitudinal jambs (14, 10).

21 Claims, 3 Drawing Figures

METHOD AND DEVICE FOR THE ALIGNING OF AN ELEMENT, E.G. FRAME, TO BE INSERTED INTO A WALL OPENING

The invention relates to a method for the aligning of an element, eg. frames, door frames, window frames or such to be inserted for example in a wall opening, whereby the space between the frame and the opening has to be partly filled in with foam, as well as to a device for the carrying out of the method, which comprises an expanding or compensating element.

In order to fit for example door frames or such in wall openings before filling in with foam the positioning is carried out by the use of wooden wedges to be inserted in the space between the frame and the wall opening. Over and over again it can be seen that when the frame is adjusted one or more wedges slip, so that the whole positioning has to be carried out again. This is obviously time consuming and expensive. For this reason 45 minutes can be given as an average time for the fitting of a frame in the correct position, this period of time including the assembly of the frame, setting and fixing in place. As soon as such a frame is fixed in place a hardening foam is inserted between frame and wall opening, which in the case of familiar foams hardens out within 24 hours. The wedges can then be removed and the frame completed with the door.

There are also quick-setting foams which harden after 8 minutes. Consequently it must be ensured that a frame once set does not have to be re-adjusted. The familiar wedge fixing elements do not always ensure this, which is not a disadvantage in the case of not so quick hardening foams, as sufficient time for re-adjusting is available during drying out.

It is the aim of the present invention to provide a method and device for the installation and setting of an element such as a frame, door frame, window frame or such in a wall opening or such, with which it is possible, due to the simple setting of the element, that wedges or such are not used. Ease of handling should be guaranteed thereby, whereby the device objects should be easy to set up.

According to the invention the aim is solved by a method characterised in that an exactly spaced and perpendicular installation of the longitudinal jambs of the element takes place through controlled pressure influence in two corner areas of the element. Thereby inflatable air bags are inserted preferably between the upper corner areas of the element and the wall opening, via which air bags there is controlled pressure influence on the longitudinal jambs and the crosspiece running between the former. The inflatable compensating element, which can be termed a flexible element, fits automatically to the large or less large spaces between wall openings and elements such as frames or such. Thereby the compensating element can be pumped up by means eg. of a bellows or inflating balloon, and also deflated by it. By the arrangement of flexible compensating elements in the corner areas a pressure influence results on the frame, vertically as well as horizontally, which ensures that with a frame once fixed in position a shifting in particular of the intrados parts is no longer possible.

In an embodiment of the invention expanding elements are placed between the longitudinal jambs of the element in order to set the distance between them and also to cancel the force of the compensating elements in the direction of the middle of the frame, thus ensuring that the intrados parts cannot be bent. This consequently prevents the intrados parts shifting towards each other during adjusting and subsequent filling in with foam and then hardening.

In the main the method is distinguished by the following steps for the setting of a door frame in a wall opening and the filling in with foam of the space between the two:

a. Arranging of a frame in a wall opening and inserting of inflatable air bags between the upper corner areas of the frame and the wall opening and the inflating of the air bags,
b. pressure increase on the air bag on the hinge side and pressure decrease on the lock-side air bag.
c. perpendicular installation of the hinge-side longitudinal jamb,
d. Inserting of an adjustable spacing element such as expanding element between frame longitudinal jambs in the area of the crosspiece and the setting of this to the required distance (specified size) of the foot of the frame,
e. Moving of the spacing element in the area of the foot of the frame jambs and if necessary renewed moving of the spacing element towards the crospice, so that the spacing element is fixed at about the lower quarter of the frame jamb,
f. Inserting of a further spacing element, setting of said element to the specified size and moving of spacing element towards foot until almost middle of frame jamb,
g. pressure reduction of air bag on hinge side and pressure increase of air bag on lock side,
h. perpendicular setting of frame jambs without changing foot,
i. setting of air bag pressure so that frame cannot move,
j. hanging of door,
k. filling in space between frame and wall opening with foam.

By the method according to the invention the time for the setting and fixing of a frame can be reduced to approx. 15 minutes, whereby this time includes the 8 minutes for the hardening up of a quick-hardening foam. In other words the construction of a frame, its setting in place, fixing, filling in with foam and door hanging can be carried out within a short space of time. According to the state of the art this is not recognisably possible with easily slippable wedges. The compensating element is optimal in connection with the expanding elements used for the controlled spacing of frame longitudinal jambs, intrados or such when the expanding element comprises two interlocking inner and outer tubes with supporting end sections to be arranged on the jambs, whereby the tubes can be made of plastic, the outer tube having a coupling nut set on the end lying opposite to the end section, whose inner thread interworks with the outer surface of a thread on the inner tube, and the end sections are in each case arranged in a detachable manner in the appropriate inner or outer tube, whereby it is however ensured that tilting towards each other is not possible.

A corresponding spacing element provides a non-corrosive element ensuring the distance between the intrados parts and such which is extremely easy to construct without its thus losing stability. The outer tube can at the same time be exchangeable in order to provide an expanding element of random lengths. The end sections themselves can be formed as plate claws, whereby tilting towards the tubes is impossible. Consequently the end sections are sections with springs. The coupling nut is preferably stuck with its inner thread on the outer tube, so that advantages in manufacture and mounting are provided. The single parts necessary for such an expanding element can be put together in a construction set, enabling the user to construct expanding elements to the required lengths, in as far as outer tubes of varying lengths are provided.

Further details, advantages and characteristics of the invention can be drawn from the claims.

The invention is described in more detail as follows via the preferred embodiments represented in the drawing, whereby further details, advantages and characteristics are given:

Figure 1:
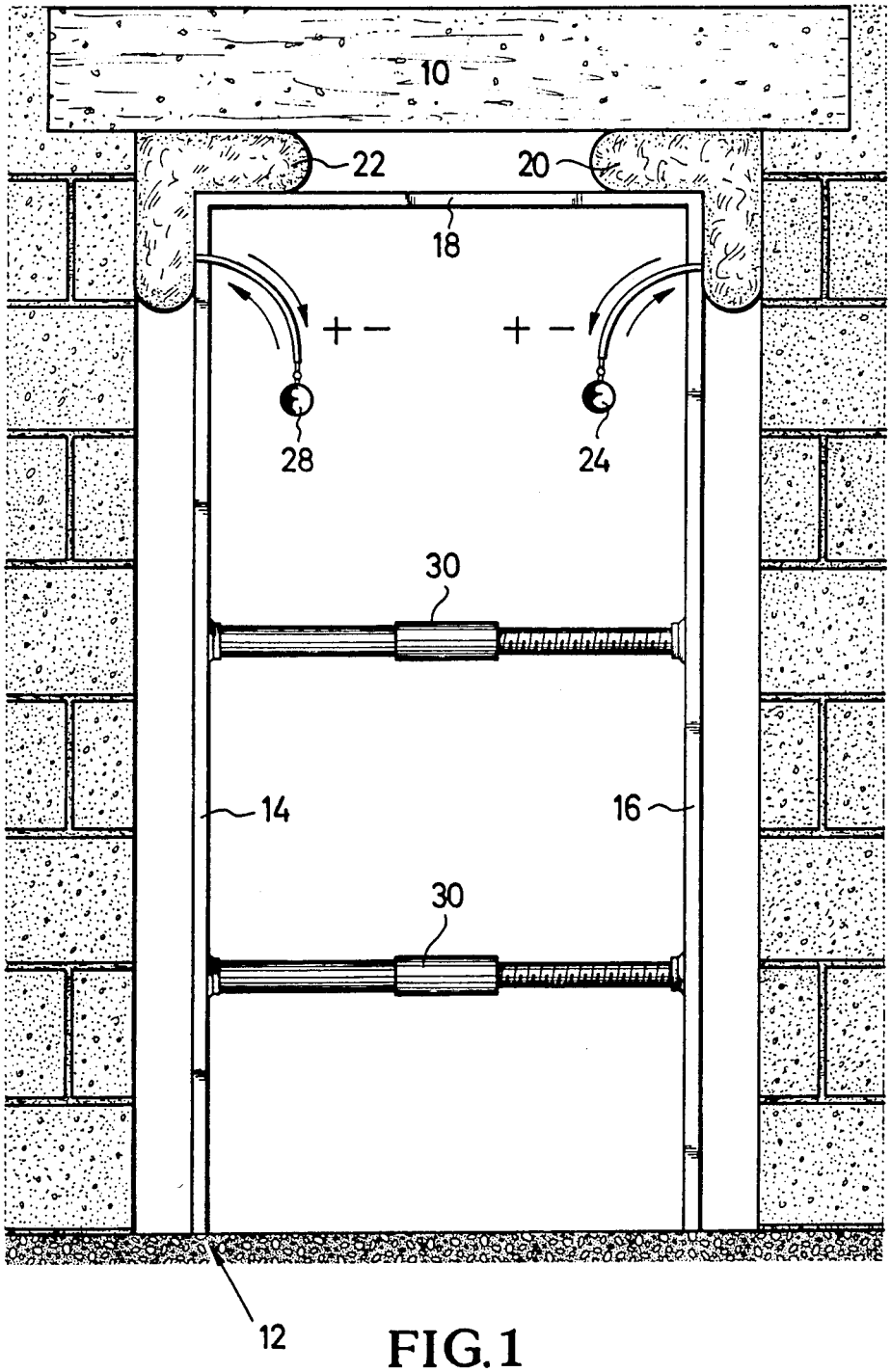
FIG. 1 shows: door frame to be set in wall opening

FIG. 1 shows purely schematically a frame 12 to be set in a wall opening 10, comprising intrados or door posts 14 and 16 as well as a crosspiece 18. There is a space between the frame 12 and the wall opening 10 which is filled in with hardening foam in order to permanently fix the frame.

Beforehand it is however necessary to position the frame correctly, ie. the required position, for which after the positioning the door is hung in order to ensure the necessary positioning to the vertical. According to the invention a compensating element 20 or 22 is inserted in the upper corner areas between door frame 12 and wall opening 10 which is formed as an air bag or air collar. This air collar 20 or 22 can be filled with air by means of a bellows 24 or 26, which can also be termed inflatable balloon. In this case the air bag 20 or 22 expands, resulting in pressure forming between the wall opening 10 and frame 12, vertically as well as horizontally. This ensures that the door posts 14 and 16 are supported firmly on the floor, so that an undesired slipping is not possible. The method steps in this case are described in more detail in connection with FIG. 3.

Expanding elements 28 and 30 are arranged between the intrados parts 14 and 16, according to a further embodiment of the invention the expanding elements consisting each of a hollow inner tube 32 and a hollow outer tube 34 with two end sections 36 and 38 as well as a coupling nut 40. The coupling nut is arranged on the outer tube 34 in the area lying opposite to the end section 36. The connection between the coupling nut or union nut 40 and the outer tube 34 can be effected by sticking. Alternately the elements can be held by exact fitting. The inner diameter of the outer tube 34 is thereby larger than the effective diameter of the inner thread. The inner thread 42 of the union nut 40 works together with an outer thread 44 which is set in the inner tube 32. Thereby the outer thread 44 can be arranged preferably over the entire length of the inner tube 42 or only over an outer area facing away from the end section 36.

The end sections 36 and 38 consist in each case of a plate-shaped external section 46 or 48 and a flange stud 50 or 52 with a smaller diameter which matches the inner diameter of the inner tube 32 or outer tube 34.

Consequently a detachable connection results between the inner tube 32 or the outer tube 34 and the end section 38. Inspite of the detachable connection is is ensured that the end sections 36, 38 cannot be tilted towards the inner tube 32 and outer tube 34 during the fixing between two elements to be spaced apart, eg. frame parts or intrados, thus ensuring that the elements themselves are the correct distance from each other, the said distance being ordained by the exterior surfaces of the end sections 36 and 38. The end sections 36 and 38, to be named plate claws, can also have elastic compensating elements 54 around them, which ensure that a compensation is provided between the free end areas of end sections 36 and 38 and the bordering facing areas of the element to be spaced apart. The elastic compensating elements 54 can be formed as fan-shaped, protruding elastic elements 56, which—as mentioned—interwork with the facing areas of frame parts or such.

The area 58 opposite the circular protruding elastic section 56 is placed on the plate-shaped sections 46 and 48, thus producing a secure connection between the elements 54 and 36 or 38.

The inner and outer tubes 32 or 34 as well as the union nut 40 and the plate claws 36 and 38 are made of plastic, resulting not only in advantages with regard to manufacture and weight without the stability of the expanding element being adversely affected, but also a construction simple to erect is provided, which is not the case in familiar door lining props alone due to the use of varying materials.

Figure 2:
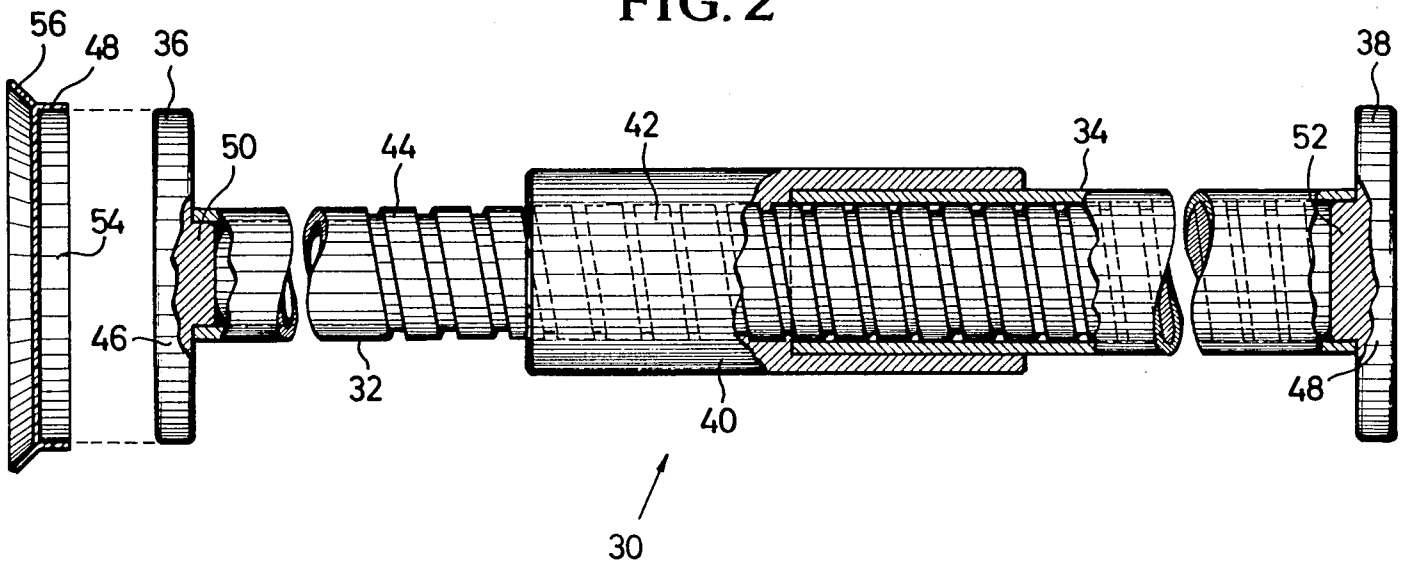
FIG. 2 shows: an expanding element
Figure 3:
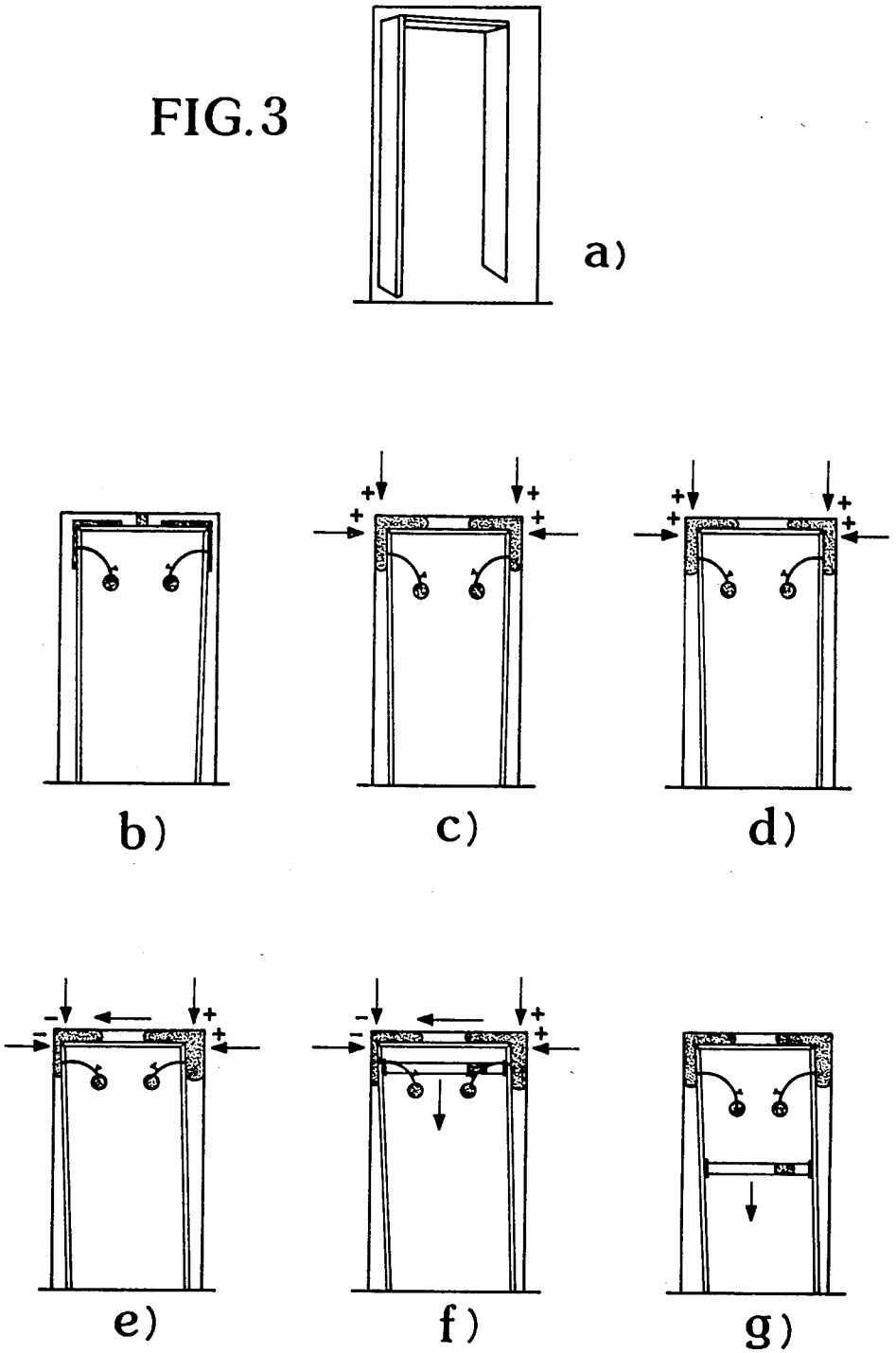
FIG. 3 shows: standard representation of setting up process for the inserting of door frame in a wall opening.
Figure 3:
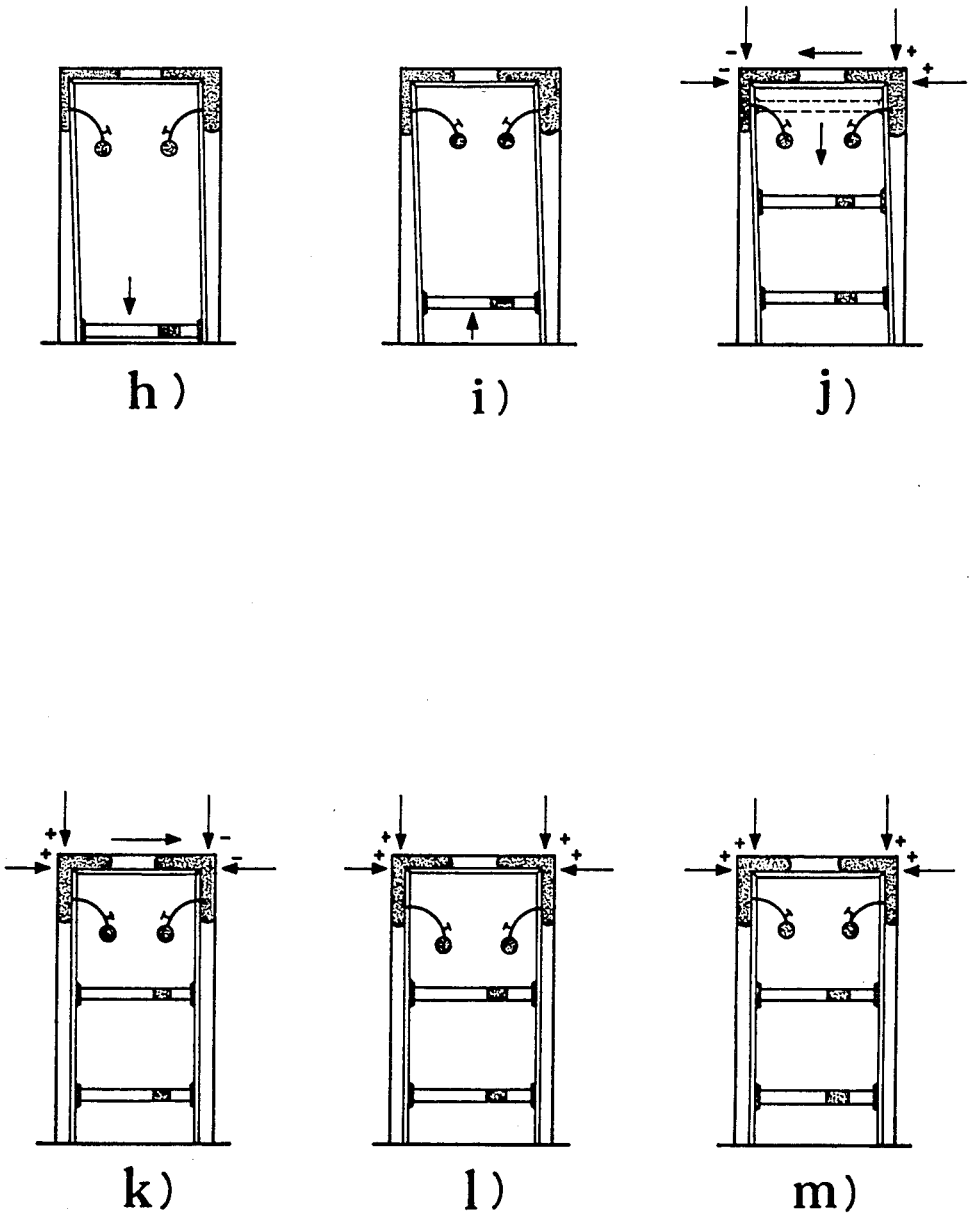

FIG. 3 represents schematically the method process of the theory according to the invention, in order to insert a door frame in a wall opening and to guarantee quick setting-up and fixing via the inflatable compensating elements and expanding elements according to the invention. After the door frame has been placed in the wall opening (a) the compensating elements such as mounting cushions are placed in the upper corner areas (b). Then the compensating elements are inflated equally, whereby the space between the corner areas of the door frame and the bordering wall opening is filled in. At the same time thereby the lock-side (left) and wall-side (right) of the frame intrados are aligned (c). Then the right longitudinal jamb, ie. the hinge-side intrados of the frame, is set perpendicular (d). After step d the hinge-side compensating element is filled with more air. At the same time the left-hand, lock-side cushion is deflated (indicated by the signs + or − in the area of the mounting cushions). Then an expanding element according to FIG. 2 is inserted in the area of the crosspiece, the external measurements of the expanding elements corresponding to the specified size of the distance between the longitudinal jambs. The expanding element is moved from the crosspiece to the foot—clarified by representations f, g and h. Thereby the lock-side jamb is placed towards the hinge-side jamb at the specified distance, the hinge-side jamb having a non-slippable footing. According to representation i the expanding element is then raised again to the level of the lower hinge. Then a second expanding element is inserted, also protruding from the crosspiece into the middle area of the frame (j, k). The lock-side mounting cushion is then inflated and the hinge-side cushion deflated, to such an extent that the longitudinal jambs are then positioned perpendicularly. To guarantee final positioning of the frame an equal pressure charging takes place then without shifting the single elements (1). Finally the door is hung on the hinges and the space between the frame and wall opening is filled in with foam in the familiar manner.

The process according to the invention shown in FIG. 3 reduces the setting time of a door frame in a wall opening by approx. 75% compared with familiar methods. Thereby it is guaranteed that in the final position the intrados parts are perpendicular, without there being the danger of bulging during the filling in with foam. This is prevented by the spacing elements. At the same time these have the effect that the vertical power produced by the inflatable compensating elements is equalled out to such an extent that the intrados parts cannot be pushed through, i.e. cannot bulge inwards.

The expanding element according to the invention can however not only be used as a setting for the specified size and pressure compensating element for frame parts, but everywhere where fixed distances have to be kept between objects, ie. between ceiling and floor, between parts of furniture, between intrados parts of windows and such.

I claim:

1. A method for aligning elements such as frames, door frames, window frames or the like in, for example, a wall opening, wherein the space between the two may have to be filled with foam and a compensating element has to be arranged in each of at least two corner areas to adjust the element inside of the opening, wherein inflatable air bags, as removable compensating elements, are placed between the upper corner areas of the element and the wall opening, said air bags exerting controlled pressure on the longitudinal jambs and the crosspiece running between said jambs.

2. The method according to claim 1 wherein the pressure towards the middle of the frame caused by the air bags is cancelled out by the expanding elements running between the longitudinal jambs.

3. The method according to claim 1 wherein fixing said frame in the wall opening takes place by inflatable air bags placed at least in the corner areas of the frame and the distance between the frame longitudinal jambs is set by spacing elements.

4. A method for the mounting of a door frame in a wall opening and the filling of the space therebetween with foam comprising a. placing said frame in said wall opening and placing inflatable air bags between the upper corner areas of said frame and said wall opening and, thereafter, inflating said air bags, b. increasing pressure on said air bags placed on the hinge side of said frame and decreasing pressure on air bags on the lock side of said frame, c. perpendicularly aligning said hinge-side longitudinal jamb, d. placing a variable spacing element between the frame jambs in the area of the crosspiece and setting said element to a desired distance from the foot of the frame, e. moving said spacing element in the area of the foot of the frame jambs, f. placing a further spacing element, setting said further element to the desired distance and moving said further element towards the foot as far as about the middle of the frame jambs, g. decreasing pressure of the air bags on the hinge side and increasing pressure of the air bags on the lock side, h. perpendicularly aligning the frame jambs without moving the foot parts, i. increasing pressure on the air bags so that the frame cannot be shifted, j. hanging of a door in said frame, and k. filling in space between said frame and said wall opening with foam.

5. A device for the controlled spacing of elements such as frame longitudinal jambs or intrados, body parts and the like comprising an expanding element with inner and outer interlocking tubes and supporting end sections on the elements wherein the tubes are of plastic, the outer tube is topped with a coupling nut on the end opposite the end section, the inner thread of the said nut interworking with the thread on the outer surface of the inner tube, and the end sections are arranged in the appropriate inner or outer tubes in a detachable and untiltable manner.

6. A device according to claim 5 wherein the inner tube has the outer thread over all or almost all of its length.

7. A device according to claim 5 or 6 wherein the pitch of the thread is about 14 mm.

8. A device according to claim 7 wherein each end section has an outer, plate-shaped section whose diameter is larger than that of the tube.

9. A device according to claim 5 or 8 wherein each end section has an elastic, pliable compensating element protruding from the plate-shaped section.

10. A device according to claim 9 wherein the compensating element is elastic, circular, and fan-shaped.

11. A device according to claim 5 wherein the coupled nut is attached to the outer tube by a union nut.

12. A device according to claim 5 wherein the outer tube is replaceable.

13. A device according to claim 5 wherein the inner tube and outer tube are, under the influence of pressure on the end sections, self-interlocking.

14. A device according to claim 13 wherein the distance between the end sections is set by controlled turning of the inner and outer tubes.

15. A device according to claim 5 for setting a door frame or the like into said wall opening wherein the space between the frame and the wall opening is to be at least partly filled with foam comprising a compensating element which is an inflatable air bag.

16. A device according to claim 1 wherein a compensating element can be sent in a detachable manner in at least each of the corner areas between the wall opening and the frame.

17. A device according to claim 5 or 15 wherein the compensating element is an air collar.

18. A device according to claim 15 wherein the compensating element can be inflated and deflated by means of a bellows.

19. A device according to claim 15 wherein the width of the compensating element corresponds approximately to the width of the frame.

20. A device to claim 15 or 19 wherein the length of the compensating element is approximately double its width.

21. A device according to claim 20 wherein the compensating elements exert pressure on the frame longitudinal jambs which can be at least partly cancelled out by an expanding element which can be placed between the frame intrados to control the spacing between the said intrados.

* * * * *